United States Patent [19]

van der Heijden

[11] Patent Number: 4,626,640

[45] Date of Patent: Dec. 2, 1986

[54] MICROWAVE ARRANGEMENT FOR HEATING MATERIAL

[75] Inventor: Bernardus F. van der Heijden, Eindhoven, Netherlands

[73] Assignee: U.S. Philips Corporation, New York, N.Y.

[21] Appl. No.: 779,770

[22] Filed: Sep. 25, 1985

[30] Foreign Application Priority Data

Oct. 2, 1984 [NL] Netherlands ..... 8402999

[51] Int. Cl.[4] ..... H05B 6/78

[52] U.S. Cl. ..... 219/10.55 A; 219/10.55 R; 34/1

[58] Field of Search ..... 219/10.55 A, 10.55 F, 219/10.55 R, 10.55 M, 10.61 R; 34/1

[56] References Cited

U.S. PATENT DOCUMENTS

| | | | |
|---|---|---|---|
| 2,483,933 | 10/1949 | Revercomb et al. | 219/10.55 A |
| 3,426,439 | 2/1969 | Ryman et al. | 34/1 |
| 3,461,261 | 8/1969 | Lewis et al. | 219/10.55 A |
| 3,597,567 | 8/1971 | Johnson | 219/10.55 A |
| 3,739,130 | 6/1973 | White | 219/10.55 A |
| 3,740,515 | 6/1973 | Vankoughnett | 219/10.55 A |
| 3,952,421 | 4/1976 | Wilson et al. | 219/10.61 X |

*Primary Examiner*—Philip H. Leung

*Attorney, Agent, or Firm*—Thomas A. Briody; Robert T. Mayer; Bernard Franzblau

[57] ABSTRACT

A microwave arrangement for heating material in a continuous process. The microwave arrangement 1 comprises a circular-cylindrical resonator 2 in which a field configuration is generated so that areas having a maximum field energy are created in the resonator 2. By passing low-dielectric loss materials 14 a plurality of times along a helical path through these areas, the efficiency is significantly improved. An embodiment which is particularly suitable for drying wire or tape-form materials 14 comprises a rotatable circular-cylindrical reel 8 via which the materials 14 are conveyed to the areas.

20 Claims, 2 Drawing Figures

MICROWAVE ARRANGEMENT FOR HEATING MATERIAL

Figure 1:
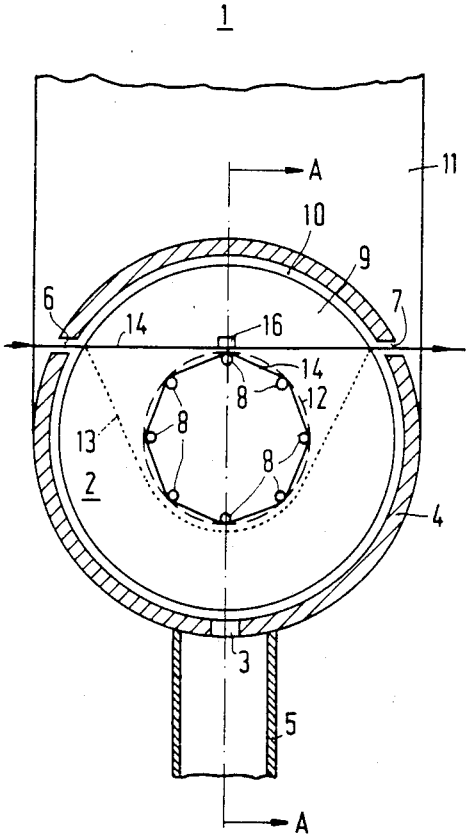

This invention relates to a microwave arrangement for heating material in a continuous process, comprising a cylindrical resonator connectable to a microwave source, the material being conveyed through the resonator via apertures provided in the wall.

Such an arrangement is disclosed in U.S. Pat. No. 3,461,261 which describes a circular-cylindrical resonator which is excited in a given mode. In the resonator, material in wire form is passed along the axis of the resonator, where a maximum electric field prevails. The material is heated due to dielectric losses produced therein by the electric field.

It has been found that the ratio between the energy absorbed by the material and the energy applied to the resonator, which ratio represents the efficiency, is low.

The invention has for an object to provide a simple and compact microwave arrangement which enables a high efficiency, more specifically for materials in the form of strips, tape or wire, and which has the ability to control the degree of heat dissipation of the material during conveyance through the resonator in a simple way.

According to the invention, the microwave arrangement is characterized in that the resonator comprises transport means for conveying the material through the resonator via a curved path and in that the resonator is dimensioned so that on excitation thereof, high field concentrations are generated in the region of the curved path. This has the advantage that materials which generally absorb little energy because of their small volume per unit of length, such as, for example, wire, tape or film-form materials, can be conveyed in a simple way through a longer path, namely via a curved path, through the resonator. This significantly increases the heating efficiency for these forms of material.

A further advantage is that varying the length of the path travelled by a material in the resonator enables the period of time the material remains in the resonator and the rate of travel to be influenced independently of each other.

A preferred embodiment of the invention is characterized in that the transport means comprise a circular-cylindrical drum arranged concentrically relative to the inner wall of the resonator for conveying the material through the resonator along a curved path located on a circular-cylindrical mantle surface. This has the advantage that by providing a plurality of turns around the transport means, the material can remain in the resonator for such a length time as is considered to be necessary for the heating process. A preferred embodiment is further characterized in that the drum is in the form of a reel with two end plates between which rods are provided at uniform distances and concentrically relative to the inner wall of the resonator. This has the advantage that it is possible to control the degree of heat dissipation of the material during its stay in the resonator.

The invention and its advantages will now be described in greater detail, by way of example, with reference to the drawings, corresponding elements having been given the same reference numerals.

Figure 2:
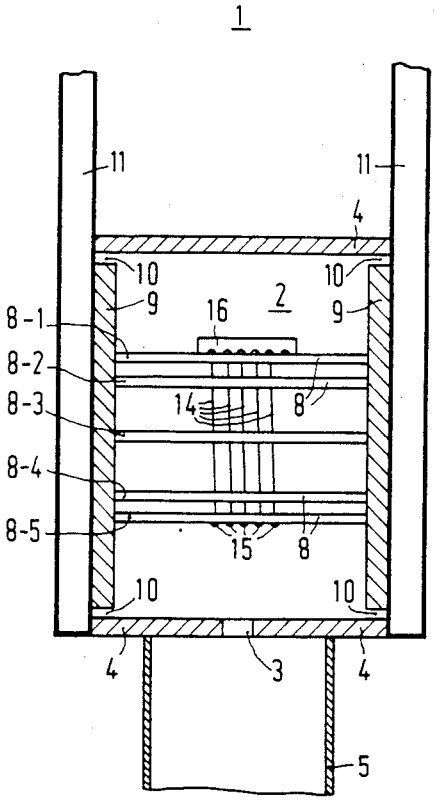

In the drawings:

FIG. 1 is a cross-sectional view through a circular-cylindrical resonator in a preferred embodiment of the invention, and FIG. 2 is a longitudinal section along the line AA of the microwave arrangement of FIG. 1.

FIG. 1 shows a microwave arrangement 1 which can be used specifically for the continuous heating of materials 14, such as yarns, threads of, for example, wool or cotton, paper, textile fabrics, film material, tapes, etc. In such a microwave arrangement 1, microwaves are used for heating, drying or curing these materials. The microwave arrangement 1 comprises a cylindrical resonator 2 which, in this embodiment is circular-cylindrical. The shape of the cylindrical resonator 2 is, however, not limited in any way to the circular-cylindrical form. Any shape of cylindrical resonator can be used, such as elliptically or coaxially formed resonators.

The resonator 2 is of such dimensions that at an operating frequency it can be predominantly excited in a given mode, as a result of which field concentrations are generated in the resonator 2. To that end, an aperture 3 is provided in the cylinder wall 4, which is coupled to a microwave source, not shown, for example a magnetron, via a partly shown waveguide 5. The microwaves applied to the resonator 2, with a desired operating frequency of, for example, 2.45 GHz, result in the resonator 2 operating in a preferred mode determined by the dimensions.

The microwave arrangement 1 shown in FIG. 1 is most suitable for heating wire or strip materials 14, which are characterized by their shape and small bulk, as will be described in greater detail below.

The material 14 is passed into the resonator 2 via an aperture 6 provided in the cylinder wall 4 and is removed from the resonator via a similar aperture 7. The size of the apertures 6 and 7 are such that they can radiate little energy. The reason for this is that on the one hand these radiation losses reduce the efficiency and on the other hand that the standards imposed by the authorities must be satisfied, as these losses may cause radiation risks near the resonator 2.

During the passage of the material 14 through the resonator 2, heat is generated in the material due to microwave losses, such as dielectric, magnetic and/or conduction losses. More specifically, when the microwave arrangement 1 is used for drying, for example to heat a substance such as water present in or on the material 14, the heat produced by the microwave losses in the material 14 and/or the substance is used for evaporating this substance.

A general problem with microwave arrangements 1 when used for heating material 14 is how to apply as much as possible of the energy applied to the resonator 2, to the material 14. An important standard for the properties of the microwave arrangement 1 is its "efficiency". The efficiency expresses the ratio between the energy absorbed by the material 14 to the energy applied to the resonator. Particularly when materials 14 having a small volume per unit of length, for example wire, tube, tape or strip-shaped materials, are used, the efficiency is low.

To increase this efficiency, transport means, for example 8, are provided in the resonator 2 for conveying the material 14 through the resonator 2 via a curved path, for example 13, shown in FIG. 1 by means of a dotted line, and the resonator 2 is so dimensioned, in a manner yet to be described, and is so excited that field concentrations occur in the region of the curved path 13. A curved path is to be understood to mean one which does not constitute the shortest path between the apertures 6 and 7.

In this embodiment a reel 8 is shown as the transport means, and comprises the rods 8-1 to 8-5 shown in FIG. 2. The invention is however not limited to the transport means shown in the Figures, but these means may have any shape. Thus, the transport means may comprise a cylindrical drum in the form of a cage or a reel 8. The drum may have a closed or an open surface structure. The open surface of the drum may, for example, have a lattice structure formed by holes, slots etc. The reel 8 may have an arbitrary number of rods, which rods may have any arbitrary cross-section, for example round, flat or polygonal and may optionally rotate separately, driven or not driven. So as to limit the losses in the transport means, they should preferably be formed from low-microwave loss materials, such as Teflon (Registered Trade Mark).

The microwave arrangement 1 is in principle suitable for excitation in a single mode or in a combination of modes, such as TE, TM and TEM-modes. More specifically, the resonator 2 shown in this embodiment may be dimensioned for resonating predominantly in a $TE_{01n}$ mode (where n is an integer). A result of exciting the resonator in this last mode, at a given value of n, is that the field concentrations are located on a circular-cylindrical mantle surface 12, represented by a dashed line, along which the material 14 can be fed through, for example, the reel 8. A cylindrical surface must be understood to mean the surface obtained by displacing a straight line parallel to itself along a closed curve. The material 14 may, for example, be passed along a curved path 13, as shown in FIG. 1 by means of a dotted line. Compared to the shortest connection from aperture 6 to aperture 7, the curved path 13 is longer, as a result of which a larger volume of the material 14 is present in the resonator 2. For the same concentration of the field per unit of path length, more energy can then be absorbed, which improves the efficiency.

Since the transport means shown in the Figures comprise a reel 8, it is possible to wind the material 14 a plurality of times around the reel 8. This increases the path length to a very large extent and causes a corresponding increase in material in the resonator 2, without the necessity of increasing the dimensions of the resonator 2. The result is a simple and very compact high-efficiency microwave arrangement 1.

It is advantageous that the period in which the material stays in the resonator and the feed-through rate can be controlled independently of each other. More specifically, it is possible to accomplish an increase in the feed-through rate of the material 14, the staying period remaining, for example, the same, by passing the material 14 via more turns 14 through, for example, a helical path along the mantle surface 12. FIG. 2 illustrates how the material 14 can be passed along the reel 8 through, for example, five turns 15.

During operation of the microwave arrangement 1, mechanical stresses may occur in the interior of the material 14 as the material 14 is heated rapidly. Further stresses may occur in the material 14 if a volatile substance in the material 14 expands rapidly, which may, for example, happen when bubbles are formed in the material 14. Both of these so-called "burst-outs" and the above-mentioned mechanical stresses may damage the material 14.

This can be obviated by providing the transport means 8 with mechanical guide means 16, such as a comb shown in the Figures, or by providing grooves, projections etc. As has already been described in the foregoing, the material 14 is passed along a helical path, generally via several turns 15, through the resonator 2. This helical path may have a pitch, which must be understood to mean the displacement of the material 14 per turn measured along the longitudinal axis of the resonator 2. The pitch of the path described by the material 14 through the resonator 2 can be determined with the aid of the mechanical guide means 16. As the field strength parallel to the longitudinal axis of the resonator 2 is not the same everywhere, but depends on the excited modes (for example for the $TE_{011}$ mode this field strength varies sinusoidally along the longitudinal axis of the resonator 2), the extent of heat dissipation by the material 14 during the period the material stays in the resonator 2 can be controlled by adjusting the pitch of the path. This makes it possible to prevent the above-mentioned damage to the material.

It is particularly advantageous that the grooves, the projections or the teeth of the comb be capable of being adjusted and positioned for each turn 15, providing the possibility of obtaining the variable pitch. Thus it is possible to control, for any type of material and at any moment in the continuous heating process, the degree of heat dissipation separately, and consequently accurately, for each turn 15.

If the transport means are in the form of a reel 8 or a circular-cylindrical drum, not shown, with a smooth surface, it is further possible to control the degree of heat dissipation as follows. Depending on the position of the apertures 6 and 7 along the longitudinal axis of the resonator 2 and depending on the number of turns 15 with which the material 14 is wound around the smooth surface, a pitch angle is obtained in the resonator 2 at which, measured relative to the longitudinal axis of the resonator 2, the matrial travels through the resonator 2. This angle is a measure of the pitch. Since the above-mentioned heat dissipation can be controlled by means of the pitch, it is possible to control the heat dissipation by adjusting this angle, more specifically by applying a larger or lesser number of turns 15, at a defined position of the apertures 6 and 7, as a result of which said damage can also be prevented.

The resonator 2 can, for example, be dimensioned to resonate at the operating frequency in the $TE_{011}$ mode. In this mode the electric field lines are concentric circles. That is to say, the electric field lines associated with this mode do not intersect the wall material. With a high electric field strength in the resonator 2, breakdown usually occurs at the wall of the resonator 2, more specifically in the region where the field lines emerge from the wall. Breakdown occurs, inter alia, due to the roughness of the wall material, which requires the surface of the wall material to be finished to a certain smoothness. As in $TE_{01n}$ modes the electric field lines do not intersect wall material, the risk of breakdown is reduced, so that the surface finish of the wall material may be less smooth and consequently may be effected at lower cost.

By winding the material 14 with more turns 15 around the reel 8 than is required for a given field strength, the power applied by the microwave source to the resonator 2 can be reduced without affecting the proper operation. This reduces the electric field strength in the resonator 2, and consequently the risk of breakdown.

If, at a given operating frequency, the resonator 2 is excited via aperture 3, the resonator 2 will resonate in the $TE_{011}$ mode, a maximum electrical field strength then occurring on a circular-cylindrical surface, the diameter of which is equal to 0.48 times the inside diameter of the resonator 2, which can easily be demonstrated theoretically. The mantle surface 12 preferably coincides with this circular-cylindrical surface. The absolute maximum of the field concentration depends inter alia also on the ratio between the inside diameter and the axial length of the resonator 2, and is obtained at a ratio of substantially 1.44.

Choosing an approximately circular-cylindrical reel 8 with a diameter equal to the diameter of the circular-cylindrical mantle surface 12, the path the material follows in the resonator 2 will be located on the mantle surface 12. This causes the material to be fed through the absolutely maximum field concentration, which realizes a preferred embodiment of a compact microwave arrangement 1 having a maximum efficiency.

The maximum efficiency is also obtained in that the electrical field lines, more specifically on excitation in the $TE_{01n}$ mode, and the magnetic field lines, more specifically on excitation in the $TM_{01n}$ mode, approximately coincide with the longitudinal direction of the material 14 wound on the reel 8. As a result thereof, the coupling of the material 14 to the respective fields is at its maximum. Because of this very good coupling, the quantity of energy absorbed from the field by the material 14 will be at its optimum and consequently also the heating.

When tape or strip-formed materials 14 are used, the shape of the apertures 6 and 7 can be adapted to the shape of the materials 14. The apertures 6 and 7 may, for example, be narrow slots which guide this material 14 without deformation through the wall of the resonator 2. The longitudinal axis of each of the slots should preferably be located so that it does not substantially intersect current lines. Identical end plates 9 are preferably provided at both ends of the resonator 2 in such a manner that they do not touch the cylindrical wall 4. This creates concentric annular apertures 10 at both end faces. The shape and location of the apertures 10 do not influence the excitation of $TE_{01n}$ modes as they do not constitute an interruption in the wall currents. With other modes, such as more specifically the TM modes, the wall currents associated with these other modes are interrupted by the apertures 10. The excitation in the resonator 2 of these unwanted other modes, when the $TE_{01n}$ mode is used, is suppressed. These two above-mentioned effects, namely not affecting the excited $TE_{01n}$ mode and suppressing the unwanted modes, result in the concentration of the field energy in the relevant $TE_{01n}$ mode.

When, more specifically, the two end plates 9 are used as end plates of the reel 8 and the reel 8 is provided in such a way that it is capable of rotation about the longitudinal axis of the resonator 2, it is possible to realize the conveyance of the material 14 through the resonator 2 in a simple way by driving the reel.

When the microwave arrangement 1 is used as a drying device, it is of further advantage that means 11 can be connected in a simple way to the apertures 10 for supplying and discharging the air required for the drying process. In view of the fact that the apertures 10 are provided in a region at the end faces near the cylinder wall 4, the air flows along the cylinder wall 4 after it has entered the resonator 2.

As the microwave arrangement 1 has unavoidable losses, the cylinder wall 4 is heated. This heat is discharged by the air flowing along it. As hot air can hold more moisture than cold air, the drying properties of a microwave arrangement when used more specifically as a drying device will be improved. Compared with the choice of a drum, choosing a reel 8 has the advantage that a larger portion of the material surface area conveyed through the resonator 2 is exposed to the air, causing the material to be dried more uniformly and faster.

What is claimed is:

1. A microwave arrangement for heating material in a continuous process comprising a cylindrical resonator having an axis and connectable to a microwave energy source, transport means for conveying the material through the resonator via apertures provided in a wall of the resonator, the transport means conveying the material through the resonator in a direction substantially perpendicular to the axis of the resonator over a curved path in a cylindrical mantle surface located concentrically relative to an inner wall of the resonator, the resonator being dimensioned so that, on excitation thereof, high field concentrations are generated in the region of the curved path whereby the material is automatically conveyed through said regions of high field concentrations.

2. A microwave arrangement as claimed in claim 1 wherein the resonator is circular-cylindrical, characterized in that the transport means comprise a circular-cylindrical drum arranged concentrically relative to the inner wall of the resonator, for conveying the material through the resonator over the curved path located on a circular-cylindrical mantle surface.

3. A microwave arrangement as claimed in claim 2, wherein the drum comprises a reel having two end plates with rods therebetween at regular distances from each other and concentrically arranged relative to the inner wall of the resonator.

4. A microwave arrangement as claimed in claim 3 wherein the resonator is dimensioned so that it resonates in the $TE_{011}$ mode at a given operating frequency, the diameter of the circular-cylindrical mantle surface being approximately equal to 0.48 times the inside diameter of the resonator, and said inside diameter of the resonator being approximately equal to 1.44 times the axial length of the resonator, thereby maximizing the field concentrations.

5. A microwave arrangement as claimed in claim 2, characterized in that the resonator is dimensioned so that it resonates in the $TE_{011}$ mode at a given operating frequency, in that the diameter of the circular-cylindrical mantle surface is approximately equal to 0.48 times the inside diameter of the resonator, and in that said inside diameter of the resonator is approximately equal to 1.44 times the axial length of the resonator, thereby maximizing the field concentrations.

6. A microwave arrangement as claimed in claim 5, wherein a flat end plate is provided at each end of the resonator such that it is spaced from the cylindrical wall of the resonator, whereby apertures are formed which attenuate unwanted modes in the resonator thereby concentrating the field energy in a desired mode.

7. A microwave arrangement as claimed in claim 6, characterized in that the transport means and the two end plates form an integral unit whereby the transport means is capable of rotation and of being driven.

8. A microwave arrangement as claimed in claim 2 wherein the transport means comprise mechanical guide means for guiding the material during its stay in the resonator in a predetermined way in the longitudinal direction of the resonator.

9. A microwave arrangement as claimed in claim 2 wherein the resonator is dimensioned so that it resonates at a given operating frequency predominately in a $TE_{01n}$ mode (where n is an integer).

10. A microwave arrangement as claimed in claim 1, wherein the transport means comprise mechanical guide means for guiding the material during its stay in the resonator in a predetermined way in the longitudinal direction of the resonator.

11. A microwave arrangement as claimed in claim 1, wherein the resonator is dimensioned so that it resonates at a given operating frequency predominantly in a $TE_{01n}$ mode (where n is an integer).

12. A microwave arrangement as claimed in claim 1, characterized in that the end faces of the resonator are provided with apertures, and the arrangement comprises means for supplying and discharging air required for the drying process via the apertures.

13. A microwave arrangement as claimed in claim 1 wherein a flat end plate is provided at each end of the resonator such that it is spaced from the cylindrical wall of the resonator, whereby apertures are formed which attenuate unwanted modes in the resonator thereby concentrating the field energy in a desired mode.

14. A microwave heating apparatus comprising: a cylindrical resonant cavity resonator dimensioned to provide a high field concentration along a curved path within the resonator, means for coupling the resonator to a source of microwave energy, said resonator having apertures in a cylindrical side wall thereof for passage of a material to be heated through the resonator, and means for transporting the material through the resonator via said apertures in a direction perpendicular to the longitudinal axis of the resonator and along said curved path, said curved path being concentrically located relative to the cylindrical side wall of the resonator.

15. A microwave heating apparatus as claimed in claim 14 wherein the transporting means comprise a coaxially arranged cylindrical member within the resonator having an outer periphery that defines an at least partly circular curved path, and wherein the material to be heated is elongate and the cylindrical member is adapted to allow the material to wrap around the outer periphery of the cylindrical member one or more times.

16. A microwave heating apparatus as claimed in claim 14 wherein the transporting means comprise a concentrically arranged cylindrical member within the resonator having an outer periphery that defines an at least partly circular curved path, said cylindrical member having a longitudinal axis parallel to the longitudinal axis of the resonator, and wherein the outer periphery of the cylindrical member is adapted to guide the material to be heated along said curved path.

17. A microwave heating apparatus as claimed in claim 16 wherein the resonator is dimensioned so that at a given microwave operating frequency it resonates predominantly in a $TE_{01n}$ mode, where n is an integer.

18. A microwave heating apparatus as claimed in claim 14 wherein the resonator is circular-cylindrical and is dimensioned so that at a given microwave operating frequency it resonates predominantly in a $TE_{01n}$ mode, where n is an integer, said resonator further comprising a pair of circular disc-shaped end plates dimensioned and arranged so as to provide annular apertures at each end of the resonator which attenuate unwanted modes in the resonator thereby concentrating the field energy in said $TE_{01n}$ mode.

19. A microwave heating apparatus as claimed in claim 14 wherein the transporting means comprise a coaxially arranged cylindrical member within the resonator having an outer periphery that defines an at least partly circular curved path, said cylindrical member having a drum-shape with a pair of end plates spaced from said cylindrical wall of the resonator so as to provide apertures at each end of the resonator which attenuate unwanted modes in the resonator thereby concentrating the field energy in a desired mode.

20. A microwave heating apparatus as claimed in claim 14 wherein the transporting means comprise a concentrically arranged cylindrical member within the resonator having an outer periphery that defines an at least partly circular curved path, wherein the cylindrical member is mounted for rotation about the longitudinal axis of the resonator and the outer periphery of the cylindrical member is adapted to contact the material to be heated.

* * * * *